US007100501B2

(12) United States Patent
Tollhupp

(10) Patent No.: US 7,100,501 B2
(45) Date of Patent: Sep. 5, 2006

(54) CHIP HOLDING ARRANGEMENT, PAD PRINTING SYSTEM INCORPORATING THE ARRANGEMENT, AND METHOD OF PAD PRINTING A CHIP USING THE ARRANGEMENT

(75) Inventor: Michel Tollhupp, Beaune (FR)

(73) Assignee: Gaming Partners International, Savigny les Beaune (FR)

( * ) Notice: Subject to any disclaimer, the term of this patent is extended or adjusted under 35 U.S.C. 154(b) by 432 days.

(21) Appl. No.: 10/160,065

(22) Filed: Jun. 4, 2002

(65) Prior Publication Data

US 2002/0185019 A1 Dec. 12, 2002

(30) Foreign Application Priority Data

Jun. 6, 2001 (FR) ..... 01 07347

(51) Int. Cl.
*B41F 17/00* (2006.01)
*B41D 7/00* (2006.01)
*B25B 11/00* (2006.01)

(52) U.S. Cl. ..... 101/41; 101/493; 269/21

(58) Field of Classification Search ..... 101/493, 101/492, 35, 41, 170; 361/234; 269/21; 73/855, 856

See application file for complete search history.

(56) References Cited

U.S. PATENT DOCUMENTS 1,475,652 A 11/1923 Polizzi
2,748,696 A 6/1956 Murray
3,484,093 A * 12/1969 Mermelstein ..... 269/21
3,652,093 A * 3/1972 Reuter, Jr. ..... 473/340
3,766,452 A 10/1973 Burpee et al.
3,868,902 A 3/1975 Bradshaw et al.
3,871,293 A * 3/1975 Valiela ..... 101/41
3,904,791 A 9/1975 Iverson et al.
3,916,784 A 11/1975 Dubuit
3,953,932 A 5/1976 Graves
3,968,582 A 7/1976 Jones
4,019,436 A 4/1977 Handweiler et al.
4,078,482 A 3/1978 Goerig et al.
4,163,813 A 8/1979 Sheets et al.
4,314,504 A * 2/1982 Combeau ..... 101/41
4,357,006 A * 11/1982 Hayes ..... 269/21
4,435,911 A 3/1984 Jones
4,508,031 A 4/1985 Rajnik
4,530,286 A 7/1985 Samuels
4,726,006 A 2/1988 Benne
4,747,093 A 5/1988 Benne
4,814,589 A 3/1989 Storch (Continued)

FOREIGN PATENT DOCUMENTS

DE 1109207 * 6/1961

(Continued)

OTHER PUBLICATIONS

Japanese Patent Abstract of French Appln. No. 2730392.

(Continued)

*Primary Examiner*—Ren Yan
*Assistant Examiner*—Marissa Ferguson-Samreth
(74) *Attorney, Agent, or Firm*—Greenblum & Bernstein, P.L.C.

(57) ABSTRACT

Holding arrangement for a chip which includes a support having a first end for supporting the chip. A vacuum chamber is arranged in the support. An annular seal is arranged at the first end. A vacuum source evacuates the chamber. A method of holding a chip in the holding arrangement includes placing the chip into the holding arrangement, pad printing the chip, and removing the chip from the holding arrangement.

41 Claims, 3 Drawing Sheets

U.S. PATENT DOCUMENTS

| | | | | | |
|---|---|---|---|---|---|
| 4,889,366 | A | | 12/1989 | Fabbiani | |
| 4,925,705 | A | | 5/1990 | Hill | |
| 5,119,724 | A | * | 6/1992 | Ng | 101/41 |
| 5,165,340 | A | * | 11/1992 | Karlyn et al. | 101/126 |
| 5,166,502 | A | | 11/1992 | Rendleman et al. | |
| 5,203,547 | A | * | 4/1993 | Marumo | 269/21 |
| 5,228,692 | A | | 7/1993 | Carrick et al. | |
| 5,306,345 | A | * | 4/1994 | Pellet et al. | 118/301 |
| 5,361,885 | A | | 11/1994 | Modler | |
| 5,403,039 | A | | 4/1995 | Borowske et al. | |
| 5,406,264 | A | | 4/1995 | Plonsky et al. | |
| 5,466,010 | A | | 11/1995 | Spooner | |
| 5,794,532 | A | * | 8/1998 | Gassies et al. | 101/493 |
| 6,148,721 | A | | 11/2000 | Hellmeier et al. | |
| 6,176,185 | B1 | * | 1/2001 | Charlier et al. | 101/493 |
| 6,264,185 | B1 | * | 7/2001 | Isobe et al. | 269/21 |
| 6,388,861 | B1 | * | 5/2002 | Frutiger | 361/234 |
| 6,467,413 | B1 | * | 10/2002 | Charlier et al. | 101/493 |

FOREIGN PATENT DOCUMENTS

| | | | |
|---|---|---|---|
| EP | 0083808 | | 7/1983 |
| EP | 0197590 | | 10/1986 |
| EP | 0251253 | | 1/1988 |
| EP | 0337921 | | 10/1989 |
| EP | 0365018 | | 4/1990 |
| EP | 03750962 | | 6/1990 |
| EP | 0581378 | | 2/1994 |
| EP | 1109207 | * | 6/2001 |
| FR | 2463683 | | 2/1981 |
| FR | 2730392 | | 8/1996 |
| FR | 2774326 | | 8/1999 |
| GB | 2076338 | | 10/1981 |
| JP | 60030344 | | 2/1985 |
| JP | 63280639 | | 11/1988 |
| JP | 2000-061493 | * | 12/1990 |
| WO | 8700796 | | 2/1987 |
| WO | 9308565 | | 4/1993 |
| WO | 9322746 | | 11/1993 |
| WO | 9843816 | | 10/1998 |

OTHER PUBLICATIONS

Japanese Patent Abstract of French Appln. No. 2463683.
Copending U.S. Appl. No. 09/638,031.
Japanese Patent Abstract of JPAppln. No. 63-280639.
Japanese Patent Abstract of JP Appln. No. 600-03044.

* cited by examiner 10
12
13
29
39
41
38
40
H
h
31
33
42
43
44
Z
Z'

10
12
13
29
39
41
38
40
31
33
42
43
44
Z
Z'

10
12
13
14
29
31
33
40
41
42
44
30
32
50
51
52
54
56
48
60
58
64
36
34
35
37
62
46
68
66
70
70'
72
89
Z
Z'

CHIP HOLDING ARRANGEMENT, PAD PRINTING SYSTEM INCORPORATING THE ARRANGEMENT, AND METHOD OF PAD PRINTING A CHIP USING THE ARRANGEMENT

CROSS-REFERENCE TO RELATED APPLICATIONS

The present application claims priority under 35 U.S.C. § 119 of French Application No. 01 07347, filed on Jun. 6, 2001, the disclosure of which is expressly incorporated by reference herein in its entirety.

BACKGROUND OF THE INVENTION

1. Field of the Invention

The present invention relates to the marking of chips or tokens for gaming tables having the general shape of a disk, or of objects of similar shape, by pad printing, and more particularly, the holding of chips or tokens during pad-printing operations. Gambling chips, also called casino chips, should be understood to mean any element which can be used in a gambling hall, especially on the gaming tables, and representing a nominal value which may or may not be predetermined. Generally, these chips are manufactured from a rigid and scratch-resistant plastic.

2. Discussion of Background Information

Chips for a gaming table are, almost systematically, given a decoration by marking on their faces and/or sides. The decoration depends on the eventual uses of the chips and ranges from the simplest to the most complex. In particular, French patent FR 2 730 392 describes the use of pad printing for marking the surface of the faces and/or the sides of chips (as opposed to volume marking using multi-shot injection molding of variously colored plastics).

The publication WO 98/43816, describes a method of marking by pad printing making it possible to mark the faces and the perpendicular side of a chip with considerable accuracy, and relates especially to marking one face and the side of the chip simultaneously. Publication WO 98/43816 also describes a pad-printing system using a holding or placement device for the chip which has an axial support with an end face intended to carry the chip. The holding or placement device is combined with vacuum suction means operating in the steady state for keeping the chip pressed directly or indirectly on the support.

Although this type of system is generally satisfactory, it is sometimes limited when holding chips under vacuum in the more tricky cases. For example, it is not very well suited for:

pad printing on chips with "granite-like" faces provided with a relief consisting of small pyramids less than one millimeter in height;

four-color pad printing which requires the perfect and continuous centering of a chip during the four successive marking operations; or pad printing a side which requires highly accurate axial positioning of the chip with respect to the pad.

In addition, the use of permanent vacuum suction in high-yield pad-printing systems capable of marking several chips simultaneously requires assemblies which are often complex in terms of suction lines and of powerful vacuum suction means increasing the costs of these plants.

SUMMARY OF THE INVENTION

As a result of the aforementioned drawbacks, there is a need for a new holding device for a chip or a token which improves the vacuum holding of the chips so as to remove or substantially reduce the limitations and other drawbacks presented above and which, in some cases, makes it possible to Her simplify the pad-printing system.

To this end, according to a first aspect of the invention, a first version of the invention provides a holding device for a chip, token or tile, especially one which can be used in pad printing. The system includes an axial support with an end face intended to carry the chip. The device is designed to be combined with a vacuum suction system for keeping the chip pressed directly or indirectly on the support. The system has a support and includes a vacuum chamber emerging via a central opening onto the end face and an annular elastomeric seal intended to cooperate with one face of the chip and placed on the end face around the opening. A system forming a multiple valve controls the isolation of the chamber or places the chamber in communication either with a vacuum suction system or with the ambient air.

The use of an elastomeric seal between the chip and the support limits the leakage (and the vacuum requirement). Furthermore, the peripheral placement of the seal very substantially increases the effective surface area of the sealed connection and of the vacuum holding force acting on the chip. Thus, when the chamber is isolated from the vacuum suction, it is possible to maintain an operational vacuum (capable of keeping the chip firmly on its support) for about one hour. The isolation between the chamber and the vacuum source makes it possible for the vacuum resource, especially the power and the flow rates of the vacuum pump, to be better controlled and used. Moreover, since it is possible to physically disconnect the holding device from the vacuum suction within the context of a high-rate multi-station pad-printing system, the vacuum circuits are very substantially simplified. In practice, it is possible to utilize only one or two stations for placing and removing chips, past which the holding devices move.

According to a first variant of the invention, the annular seal is made from an elastomeric material chosen from synthetic or natural rubbers, polyurethanes and silicones.

According to another variant of the invention, the annular seal is a washer with flat faces. The use of a washer with flat faces makes it possible, on the one hand, to provide good sealing with chips whose faces have a slight relief (for example chips with "granite-like" faces), and on the other hand, to already provide the chip with good seating for the pad-printing procedure of the chip faces.

Advantageously, the annular seal is placed close to the periphery of the end face of the support in order to increase as much as possible the effective vacuum bearing area and consequently the force for holding the chip due to the vacuum, According to yet another variant of the first version of the invention, the end face of the support comprises a stiff peripheral supporting ring arranged radially outside the annular seal and intended to act as a fixed bearing surface for the chip. The seal protrudes slightly in an axial direction outside the ring when at rest, in order to provide vacuum-tight sealing at the face of the chip. Thus, the peripheral supporting ring lying in a plane perpendicular to the axis of the support provides perfect seating and a constant axial position with respect to the pad-printing pad. This enables side pad-printing with very high accuracy, including sequential multicolor pad printing.

According to another variant of the invention, the support carries, on the perimeter of its end face, a mechanism for centering the chip. The mechanism can be retracted axially and projects beyond the supporting ring in the extended position. Advantageously, the centering mechanism includes a centering collar secured to a sleeve sliding over the axial support. An elastic biasing system tensions the collar toward its extended position.

It should be noted that keeping an operational vacuum in the vacuum chamber for a fairly long period of time enables early retraction of the centering ring (the combination of retracting the centering ring with the descent of the pads having become superfluous) and also simplifies the mechanical devices used.

According to a variant of the invention, the mechanism forming a multiple valve is a three-way valve capable of isolating the vacuum chamber or of connecting the chamber either to the vacuum suction system or to the open air.

According to another variant of the invention, the mechanism forming a multiple valve is a connection assembly with two non-return valves (or no-return valves or one-way valves)comprising two separable end pieces. One of these end pieces is a connection and isolation end piece with a non-return valve designed to be connected to the vacuum chamber and another is a suction end piece with a non-return valve designed to be connected to the vacuum suction system. The two non-return valves are mounted face to face in order to butt against each other in a double opening position when the two end pieces are connected.

Advantageously, the support is mounted on a stand which can be moved over a frame placed in front of at least one pad-printing station comprising an ink pad moved coaxially with the chip in combination with a flat inking plate.

Of course, the invention is not limited to gambling chips, tokens and tiles but relates to any type of chip or tile, especially parking tokens, any sort of payment tokens, passes, etc.

The invention also relates to a novel pad-printing system that uses more than one holding device. This arrangement makes it possible to work on objects with a substantially flat face which have to be securely held by vacuum suction, such as for example etching or printing system and the like.

In particular, the invention provides a pad-printing system or arrangement of the type comprising at least one pad-printing station including an ink pad which can be moved coaxially towards the chip in combination with a flat inking plate and at least one holding device according to the invention. The system also includes a vacuum suction system and at least one holding device which is movable on a transfer track provided on a frame.

Advantageously, the pad-printing system includes, in the vicinity of the frame, at least one chip placement/removal station in which a suction end piece can be connected to the vacuum suction system.

According to a second aspect of the invention, a second version of the invention also provides a holding device for a chip, token or tile, which can be used for pad printing. The system includes an axial support with an end face intended to carry the chip. The device is designed to be combined with vacuum suction mechanism emerging on an end face in order to keep the chip pressed directly or indirectly on the support. The face of the support includes a stiff peripheral ring intended to act as a fixed bearing surface for the chip and an annular elastomeric seal arranged adjacent to the ring, inside the latter, and placed around the inlet providing the vacuum suction. The seal protrudes slightly in an axial direction outside the ring when at rest in order to provide vacuum-tight sealing at the face of the chip in contact with the seal.

This type of holding device is well suited for side pad-printing. This is because the peripheral supporting ring lying in a plane perpendicular to the axis of the support provides perfect seating and a constant axial position with respect to the pad-printing pad, which makes it possible to carry out the side pad-printing with very great accuracy, including in multicolor.

According to the use requirements, the holding device according to the second version optionally incorporates some of the optional features of the first version of the invention already presented beforehand and wherein, without limitations, the annular seal is a washer with flat faces and/or the annular seal is made from an elastomeric material chosen from synthetic or natural rubbers, polyurethanes and silicones. The support may carry, on the perimeter of its end face, a mechanism for centering the chip. The mechanism can be retracted axially and projects beyond the supporting ring in the extended position. The centering mechanism includes a centering collar secured to a sleeve sliding over the axial support. An elastic biasing system tensions the collar toward its extended position.

Similarly, the holding device according to the second version of the invention can be integrated into a new pad-printing system according to the invention. As a non-limiting example, the support is mounted on a stand which can be moved over a frame placed in front of at least one pad-printing station comprising all ink pad which can move coaxially with respect to the chip in combination with a flat inking plate.

The invention also provides for a holding arrangement for a chip comprising a support having a first end which can support the chip, a space or chamber arranged in the support, an annular seal arranged at the first end, and a vacuum source which evacuates the space or chamber. The annular seal may be compressed when the chip is installed on the first end and when the chamber is evacuated. The support may comprise a cylindrically shaped support having a central opening, the annular seal being arranged concentrically with the central opening. The holding arrangement may further comprise a multiple valve assembly coupled to the chamber, wherein the multi valve assembly allows a user to control the pressure inside the chamber. The holding arrangement may further comprise a multiple valve assembly coupling the chamber to the vacuum source. The holding arrangement may further comprise a multiple valve assembly which removably couples the chamber to the vacuum source. The chip may comprise one of a gambling chip, a token and a tile. The holding arrangement may be adapted to be used in a pad printing system. The annular seal may comprise an elastomeric material. The annular seal may comprise at least one of a synthetic or natural rubber, a polyurethane, and a silicone. The annular seal may be a washer having flat faces. The annular seal may be arranged concentric to an axis running through the support. The first end of the support may comprise a ring-shaped support portion. The ring-shaped support portion may be sized to receive the annular seal. The annular seal may project above an upper surface of the ring-shaped support portion. The annular seal may be compressed by an amount equal to the amount that the seal projects above an upper surface of the ring-shaped support portion, when the chip is installed on the first end and when the chamber is evacuated. The annular seal may ensure a vacuum-tight sealing between a face of the chip and the annular seal.

The holding arrangement may further comprise a centering device for centering the chip on the support. The centering device may be axially movably mounted to the support. The first end of the support may comprise a ring-shaped support portion. The centering device may be movable from an extended position above the ring-shaped support portion to a retracted position below the ring-shaped support portion.

The centering device may include a centering collar secured to a sleeve which can slide with respect to the support. The holding arrangement may further comprise at least one mechanism for biasing the centering device towards an extended position. The holding arrangement may further comprise at least one mechanism for biasing at least one of the centering collar and the sleeve towards an extended position.

The holding arrangement may further comprise a multiple valve assembly coupled to the chamber, wherein the multiple valve assembly allows a user to control the pressure inside the chamber and wherein the multiple valve assembly comprises a three-way valve which is capable of isolating the chamber and of connecting the chamber either to the vacuum source or to the ambient air. The multiple valve system may include a connection system. The connection system may comprise two non-return valves having two disconnectable end pieces. One of the two disconnectable end pieces may be a connection and isolation end piece having a non-return valve and being configured to be connected to the chamber. One of the two disconnectable end pieces may be a suction end piece having a non-return valve and being configured to be connected to the vacuum source. One of the two disconnectable end pieces may be a connection and isolation end piece having a non-return valve and being configured to be connected to the chamber and another of the two disconnectable end pieces may be a suction end piece having a non-return valve and being configured to be connected to the vacuum source, and wherein the two non-return valves are mounted face to face in order to butt against each other in a double opening position when the two end pieces are connected.

The support may be mounted on a stand. The support may be mounted on a movable stand. The holding arrangement may further comprise a frame wherein the stand is movable with respect to the frame. The holding arrangement may further comprise at least one pad-printing station comprising an ink pad which can be moved coaxially and a flat inking plate, wherein the support is movable from a position outside the pad printing station to a position within the pad printing station.

The invention also provides for a pad-printing arrangement for printing a chip comprising at least one pad-printing station which includes an ink pad that is movable towards and away from the chip and a flat ink plate, at least one holding device including a support having a first end which can support the chip, a vacuum chamber arranged in the support, an annular seal arranged at the first end, and a vacuum source which evacuates the chamber, the support being mounted on a movable stand, and a frame having a track mounted thereto, wherein the stand is movable on the track, and wherein the support is movable from a position outside the pad printing station to a position within the pad printing station.

The pad-printing arrangement may further comprise at least one chip placement/removal station arranged adjacent the frame.

The invention also provides for a holding arrangement for a chip comprising a support having a first end which can support the chip, a space or vacuum chamber arranged in the support, a seal arranged at the first end, and a vacuum source which evacuates the space or chamber, wherein the seal is compressed when the chip is installed on the first end and when the chamber is evacuated.

The seal may comprise an elastomeric material which comprises at least one of a synthetic or natural rubber, a polyurethane, and a silicone. The seal may be a washer having substantially flat faces. The holding arrangement may further comprise a centering device for centering the chip on the support. The centering device may be axially movably mounted to the support. The first end of the support may comprise a ring-shaped support portion. The centering device may be movable from an extended position above the ring-shaped support portion to a retracted position below the ring-shaped support portion. The centering device may include a centering collar secured to a sleeve which can slide with respect to the support. The holding arrangement may further comprise at least one mechanism for biasing at least one of the centering collar and the sleeve towards an extended position. The support may be mounted on a movable stand. The holding arrangement may further comprise a frame wherein the stand is movable with respect to the frame. The holding arrangement may further comprise at least one pad-printing station comprising an ink pad which can be moved coaxially and a flat inking plate, wherein the support is movable from a position outside the pad printing station to a position within the pad station.

The invention may further provide for a method of holding a chip in a holding arrangement that includes a support having a first end which can support the chip, a space or vacuum chamber arranged in the support, an annular seal arranged at the first end, and a vacuum source which evacuates the space or chamber, the method comprising placing the chip into the holding arrangement, pad printing the chip, and removing the chip from the holding arrangement.

Before the pad printing, the method may further comprise moving the holding arrangement to a pad printing station. The moving may comprise moving the holding arrangement on a track system. The track system may comprise a lower track which guides the holding arrangement and an upper track which moves a device for centering the chip on the support.

BRIEF DESCRIPTION OF THE DRAWINGS

The present invention is further described in the detailed description which follows, in reference to the noted plurality of drawings by way of non-limiting examples of embodiments of the present invention, in which like reference numerals represent similar parts throughout the several views of the drawings, and wherein:

FIG. 5*c* illustrating, in longitudinal section, both end pieces when connected.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description is taken with the drawings making apparent to those skilled in the art how the forms of the present invention may be embodied in practice.

Figure 1:
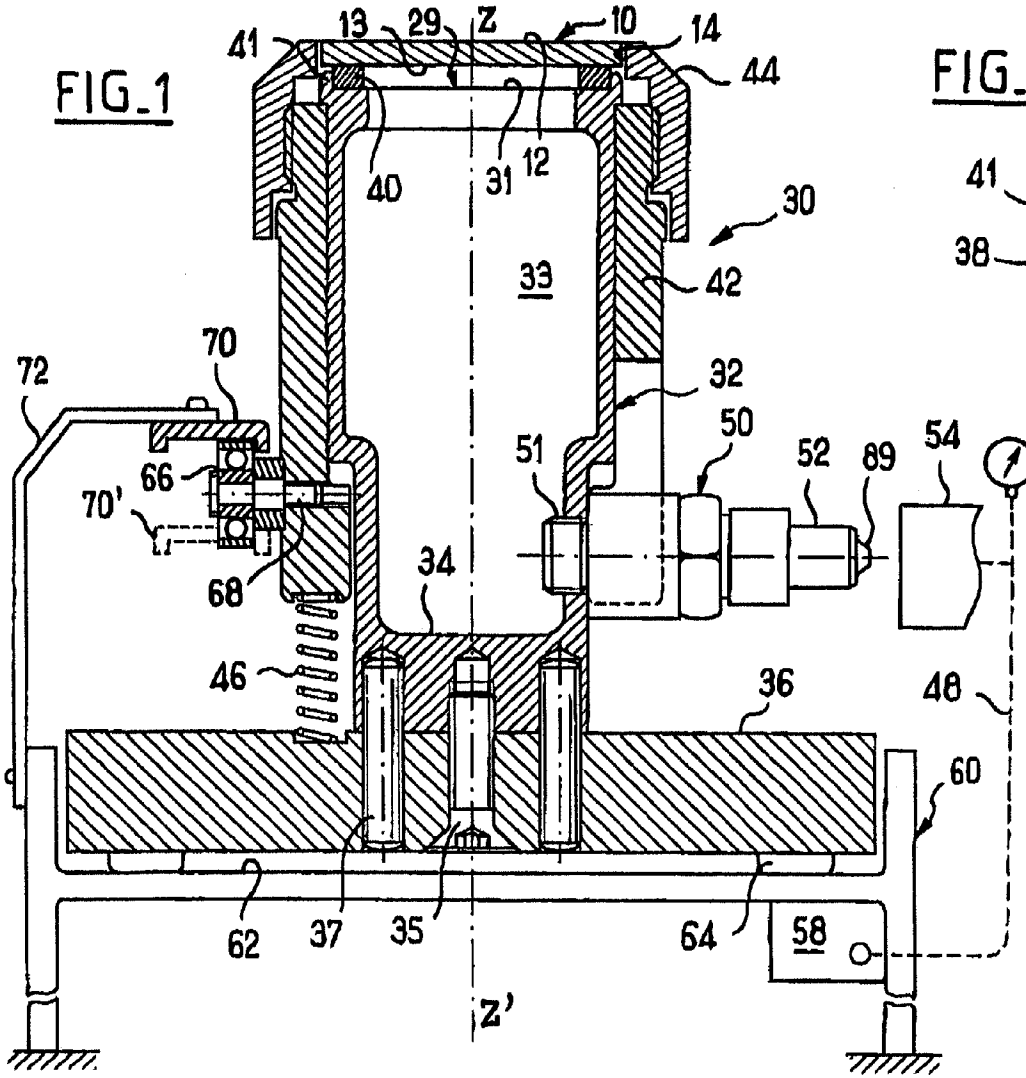
FIG. 1 represents a view in axial section of a holding device according to the invention and incorporating both versions thereof.

FIG. 1 represents a sectional view of a holding device 30 for a plastic chip or token 10 and designed, by way of non limiting example, to be incorporated in a pad-printing system or arrangement in order to mark, with an ink and/or varnish decoration, the faces and a perpendicular side of a disk-shaped chip 10. The chip 10 has circular parallel faces. The holding or placement device 30, according to the invention and which will be described in detail below, has the main functions of acting as a horizontal bearing or support surface for the chip 10 and of holding the chip in place, i.e., centered on the axis ZZ' of the pad 134, for the duration of the pad-printing operations.

By way of a non-limiting example, the disk-shaped chip 10 having the parallel faces, is the kind of chip that is used on gaming tables and which has a diameter of approximately 40 mm and a thickness or a side height of approximately 3.3 mm. In some cases, the edges of the chip may have a very slight chamfer (of approximately 0.1 mm). Similarly, the faces of the chip may be "granite-like" such as, e.g., when such is requested by a customer, i.e., a casino.

Of course, without departing from the scope of the invention, the gambling chip or token is replaced by an object of similar shape made from a material capable of receiving a decoration by pad printing or by other known printing methods.

Figure 3:
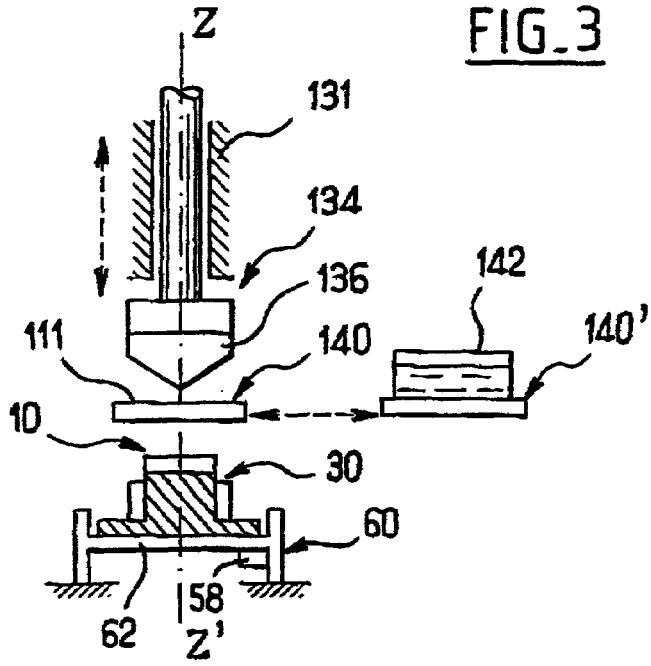
FIG. 3 represents the outline diagram of a pad-printing plant incorporating the holding device of FIG. 1.

The operation of marking, by pad printing, the side of a gambling chip with a perpendicular side, together with one of the faces of the chip if desired, is capable of being implemented by various types of devices, machines or systems. By way of non-limiting example. FIG. 3 illustrates the principle of such a pad-printing system or arrangement according to the invention allowing the simultaneous marking of one of the faces and of the side of a disk-shaped gambling chip or of an object of similar shape.

With reference to FIG. 3, reference 30 represents very schematically the chip holding device according to the invention of FIG. 1. An ink pad 134 is mounted on a vertical frame 131 so that it can be moved in vertical reciprocating motion. The vertical frame 131 is combined with the frame 60 carrying the holding device so as to align, on the same axis ZZ', the axis of the pad 134 (and of its head 136) with the axis of the holding device 30 carrying the chip (the axis ZZ' then passing through the center of the chip 10). The pad 134 has an axially symmetrical deformable head 136 of axis ZZ' made of synthetic material (for example a synthetic silicone rubber having a Shore A hardness of about 6), in this case with a conical end 138. As will be seen later, the deformable head 136 is designed to bed down on the face 12 and on the edge 16 of the chip 10 while the perpendicular side 14 of the chip 10 is being marked. A plate holder 140, carrying a flat ink plate 111 (which incorporates for example the image of a side decoration) is capable of reciprocating motion between the position vertically beneath the pad 134 (position 140) and the position vertically beneath an ink reservoir 142 (position 140').

The pad-printing operation proper is carried out in the following manner. After inking the plate 111 (position 140'), the plate holder is moved into the position 140 coaxial with the pad 134 so as to place a ring-shaped zone of the plate 111 carrying a decoration image, coaxially with the pad 134. A first downward vertical movement of the pad 134 allows the ink to be picked up simply by applying pressure. After the pad 134 has been raised and the plate holder is retracted (back to the position 140'), the pad 134 undergoes a second downward vertical movement in order to deposit the ink onto the chip by pressing the pad 134 firstly on the face 12 of the chip 10 and then, by further deformation of the head of the pad 136, on the peripheral side 14 of the chip 10. In this way, the marking of the chip 10 with a monochrome (final or intermediate) decoration is thus achieved. In the case of multicolor printing (i.e., wherein the chip is to receive an image having more than one color), the final decoration is formed by a complementary and/or the superimposition of two or more monochrome decorations, each of these intermediate decorations being etched on separate plates. In the case of multicolor marking, either several movable plate holders or a series of monochrome pad-printing units associated with a movable chip holder support can be used. In general, the ink plates are etched to a depth of between approximately 18 μm and approximately 20 μm. Moreover, various types of inks and/or varnishes suitable for pad printing can be used, especially those of the UV-visible ink types for discrete marking (for example in the case of chip identification numbers and/or codings).

With regard to the formation of decoration images for the faces and/or for the side on the ink plates, (especially the decoration image of the side according to the general principle of preparing plates by folding up the decoration over a reference plane such as the face of the chip and radial contraction of the intermediate decoration) and with regard the details of pad-printing operations on chips, the invention expressly incorporates by reference, in its entirety, U.S. Pat. No. 6,176,185 (a counterpart of publication WO 98/43816).

Figure 2A:
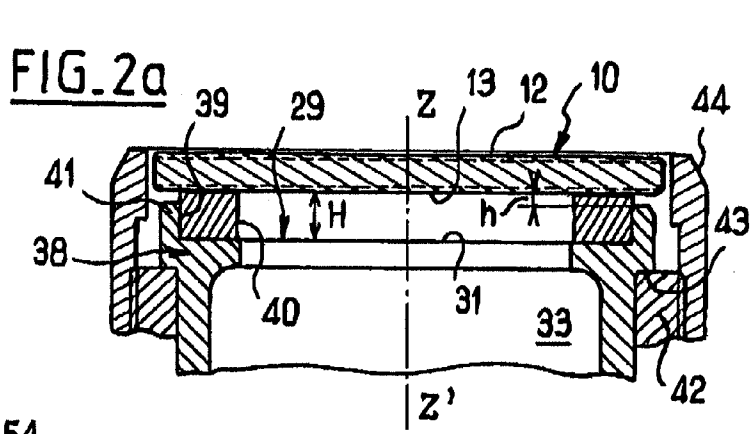
FIGS. 2*a* and 2*b* represent two schematic views partially in section showing the respective positions of the chip and of the chip support of the holding device of FIG. 1 corresponding respectively at rest in the absence of a vacuum (FIG. 2*a*) and after evacuation of the vacuum chamber (FIG. 2*b*)

Returning to FIG. 1, the holding device 30 for the chip 10 comprises a rigid axial support 32 made of metal (or other suitable rigid material, conventional or otherwise) having substantially the shape of a hollow cylinder of axis ZZ' and including a central opening 31 located at its upper end face 29. A thick base 34 is arranged at a lower end and is rigidly fastened to a stand 36 (which may be made of metal or other suitable material) by way of screws 35 and pins 37. Of course, the base 34 may be attached to the stand 36 by other suitable attachment mechanisms, whether conventional or otherwise, and the support 32 and stand 36 may even be made as a one piece structure without leaving the scope of the invention. Arranged at the level of the upper end face 29, the cylindrical wall of the support 32 is thickened in order to form an annular enlarged portion 38 which has a step (see also FIGS. 2*a* and 2*b*). An inner shoulder 39 is used to accommodate an annular seal 40 which may be a washer that is made of an elastomer having parallel faces and a thickness H at rest (in the absence of a vacuum) that is slightly greater than the axial height of the shoulder 39 (see FIG. 2*a*). A stiff peripheral supporting ring 41 lies in a plane perpendicular to the axis ZZ' and is used to accommodate, in a rigidly supported manner, the lower face 13 of the chip 10 after the washer 40 is compressed under the effect of a force due to the vacuum acting on the chip 10 from inside the chamber 33 (see FIG. 2*b*). Arranged on the outer periphery of the support 32 is an outer shoulder 43 intended to act as an end stop for a sleeve 42. The sleeve 42 carries a collar 44 which is used for centering the chip 10 on the holding device 30. The sleeve 42 is slidably axially movably mounted onto the support 32. The sleeve 42 and the collar 44 are movable coaxially along the axis ZZ' and are biased and/or stressed towards the extreme extension position (see FIG. 1) by three helical springs 46 which are distributed (substantially equally spaced) around the perimeter of the base of the sleeve 42 (only one of the springs 46 is visible in FIG. 1). The collar 44, which is removably mounted to the sleeve 42 so as to be interchanged, is secured to the sleeve 42 by screwing (i.e., a threaded connection). The collar 44 has an internal diameter portion which substantially corresponds to the diameter of the chip 10 (plus some clearance which accounts for the size variation of the chip). The collar is also arranged axially and acts as a continuation of the ring 41 so as to produce and/or define a housing which receives the chip (the chip 10 via its lower face 13 bears, when at rest in the absence of a vacuum, on the upper face of the elastomeric washer 40 protruding slightly outside or above the ring 41 as illustrated in FIGS. 1 and 2*a*). The collar 44 is made retractable (in a downward direction) by pressing downward. As can be seen in FIG. 1, a ball bearing 66 is mounted to the sleeve 42. The bearing 66 can rotate freely on a horizontal spindle 68 that is fastened to the sleeve 42. The bearing 66 mechanically rides against and/or on an upper track or rail 70 which is fastened to a frame 60 by brackets 72.

Figure 5B:
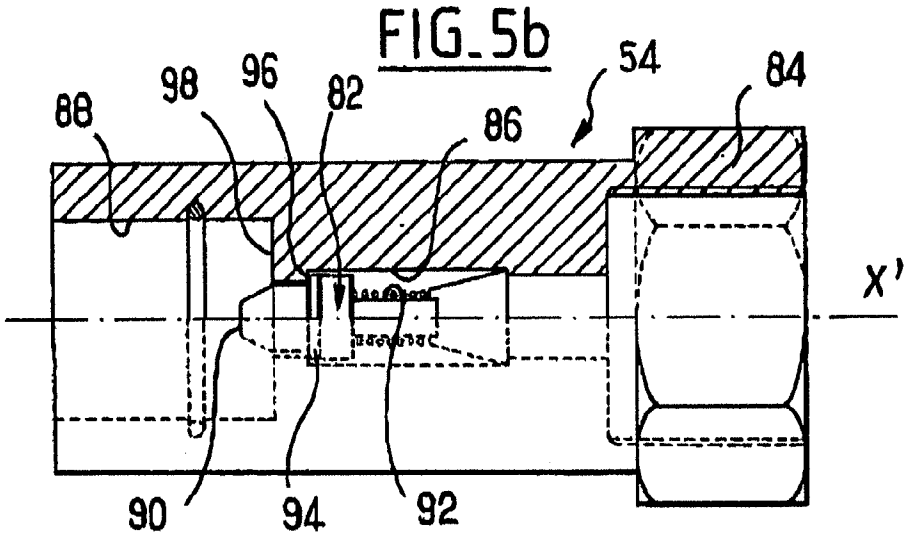
FIGS. 5*a*, 5*b* and 5*c* represent a connection with two end pieces which is used in the holding device of FIG. 1, FIGS. 5*a* and 5*b* respectively illustrating, in partial section, the two disconnected end pieces.
Figure 5A:
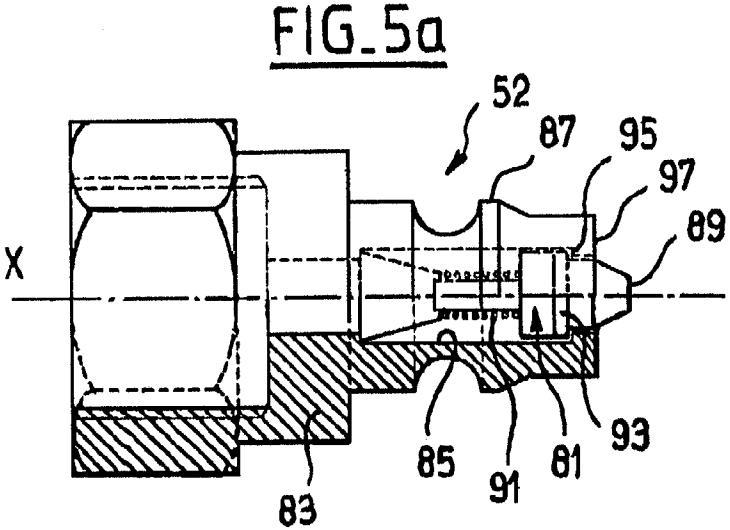
Figure 5C:
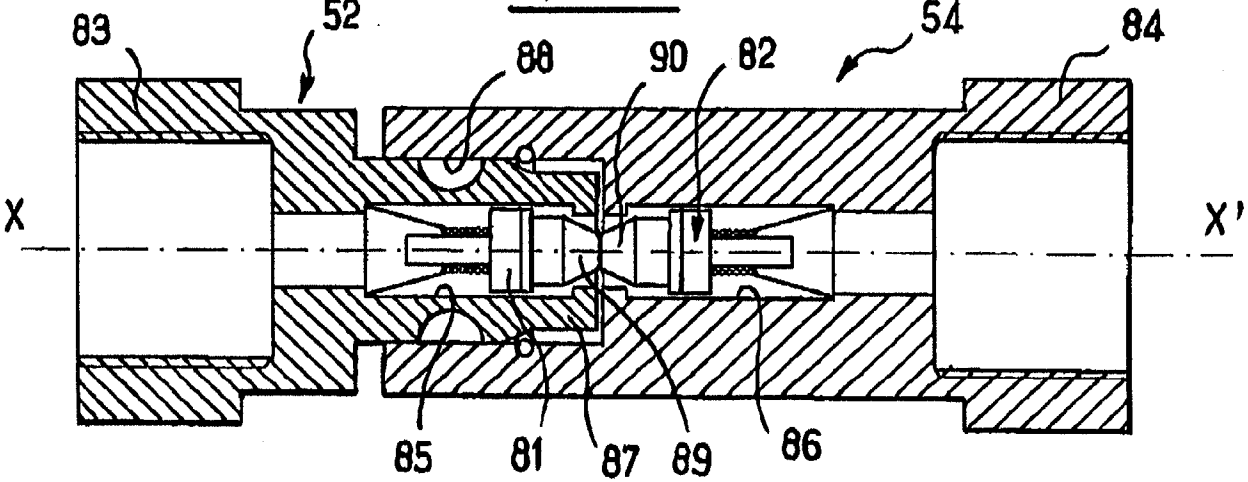

The hollow cylinder of the support 32 defines a space 33 or chambers i.e., a vacuum space or chamber, which is capable of being connected to a vacuum line 48 (indicated by dashed lines) by way of a multiple valve SO. The multiple valve 50 includes a through socket portion 51 which is mounted through the wall of the cylindrical support 32. Also included is an "anti-leak" pneumatic connection assembly which has two non-return valves (or no-return valves or one-way valves) which include two separable end pieces 52 and 54. End piece 52 is a connection and isolation end piece which has a movable non-return valve 81 and is connected to the vacuum chamber 33 via the socket 51. End piece 54 is a suction end piece which has a non-return valve 82 and is connected to the vacuum suction line 48. As illustrated in FIGS. 5*a* and 5*b*, each of the bodies 83 and 84 of the respective end pieces 52 and 54 have a cylindrical shape and are traversed by bores 85 and 85 which have an axis XX' 85. The two non-return valves 81 and 82 are mounted in a face to face manner. FIGS. 5*a* and 5*b* show each if the valves 81 and 82 in the closed position, i.e., the valves 81 and 82 are closed when the two end pieces 52 and 54 are disconnected from one another. End piece 52 has a small-diameter head portion 87 which is capable of sliding into an opening in end piece 54 when end pieces 52 and 54 are connected to one another. The head 87 and opening portion 88 have substantially the same diameter (with a small clearance). As can be seen in FIG. 5*c*, when end piece 52 is slid into end piece 54, the bore 86 becomes coaxially aligned with bore 85. A stop position is defined between the face 97 of the head 87 and the shoulder 98 of end piece 54. As is shown in FIG. 5*c*, in the connected position, the valve heads 89 and 90 become open, i.e., they are moved back into their respective bores 85 and 86 from a normal position projecting outside the face 97 and the shoulder 98 (see FIGS. 5*a* and 5*b*). When the end pieces 52 and 54 are disconnected from one another (see FIGS. 5*a* and 5*b*), the valves 81 and 82 close again. The valves 81 and 82 are thus designed to butt against each other in a double opening position when the two end pieces 52 and 54 are connected (the springs 91 and 92 being compressed in order to free the annular seals 93 and 94 from their seatings 95 and 96 formed by small shoulders in the bores 85 and 86). In this way, when the end pieces 52 and 54 are connected to one another, as illustrated in FIG. 5*c*, the two bores 85 and 86 are free to communicate and the vacuum chamber 33 can be coupled to the vacuum suction line 48 and the vacuum supply 58. A manometer 56 is also connected to the line 48. On the other hand, when the two end pieces 52 and 54 are disconnected from one another, as illustrated in FIGS. 5*a* and 5*b*, the two valves 81 and 82 move to their closed positions, with the result that the vacuum chamber 33 becomes isolated from the open air. However, because the chip 10 acts to seal off the opening 31 of the chamber 33, the vacuum is maintained in the chamber 33. Finally, when the operator wishes to free the chip 10 from the holding device 30, such may be done by allowing open air into the chamber 33. This can be accomplished by slightly depressing the valve 81 in an axial direction. As soon as the valve 81 is pushed back into the bore 85, air will rush into chamber 33 until the pressure in the chamber 33 equals the pressure outside the chamber 33. Of course, it should be noted that the invention contemplates that the valve 81 can be pressed and/or opening either manually or in an automated manner, i.e., by applying force on the head 89 toward the left in FIG. 1.

The pump 58 is suitably arranged and/or attached to the frame 60 carrying a transfer track 62. The track 66 is designed to support one or a plurality of holding devices 30 which each carry a chip 10 which is to be pad printed. Each holding device 30 thus moves on the tract 62. To facilitate this movement, the stands 36 of the holding device 30 are equipped with runners 64. In this way, each holding device 30 can be moved past one or more pad-printing stations, such as the one shown in FIG. 3. The system allows for the accurate moving of the stand 36 on the transfer track 62 so as to align the axis of the holding device 30 (and hence the center of the chip 10) with the axis ZZ' of the pad 136. Moreover, the rail 70, on which the bearing 66 has continuous rolling contact, is arranged to continuously follow the track 62. However, it is noteworthy that the distance between the upper tract 70 and the lower track 62 is not kept constant for an entire length of the tract 62. Instead, a height or distance between these tracks 70 and 62 varies between a high position illustrated by 70 in FIG. 1, (a position which corresponds to the extended position of the collar 44 (the extended position being needed to center the chip 10 when it is positioning on the holding device 30)) and a low position illustrated in dashed lines by 70' corresponding to the retraction of the collar 44 (the retraction being needed during the operation of pad printing the side 14 of the chip 10 (see e.g., FIG. 4*b*)).

It should be noted that, without departing from the scope of the invention, another embodiment of the holding device 30 may utilize, in place of the end pieces 52 and 54, a three-way valve (not shown) which is capable of isolating the vacuum chamber 33 or of connecting the chamber 33 to either a vacuum suction supply 58 or to venting orifice. In another embodiment (not shown) it is possible to place an air intake valve through the wall of the cylindrical support 32 of the vacuum chamber 33.

Figure 2B:
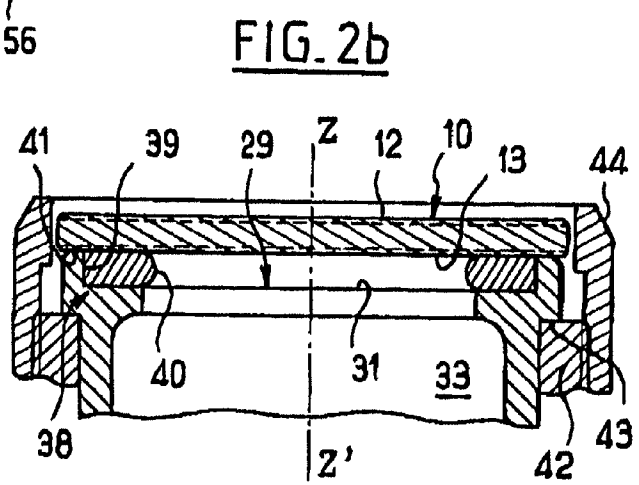

With regard to the annular seal 40, it may be made from an elastomer such as, e.g., a synthetic or natural rubber(s) or mixture thereof, a polyurethane(s) or mixture thereof, and a silicone(s) or mixture thereof. In the embodiment described here, a silicone seal is preferred which has a hardness of about 6 in the Shore A scale (a hardness which is substantially the same hardness as that of the head of the pad 138). With respect to the shape of the seal 40, an O-ring seal having a circular cross section could be utilized in place of a washer. However, it is often preferable to use washers of various thicknesses since such washers have flat faces which are better able to seal to the chip 10 (especially when the flatness of the faces of the chip is imperfect or has "granite-like" texture or arrangement). Thus, FIGS. 1–2*b* illustrate one preferred holding device 30, even though the invention contemplates other configurations.

As represented in FIG. 2*a*, the thickness "H" of the washer 40 is chosen to go or extend beyond the shoulder 39, when at rest (i.e., no vacuum in chamber 33), by a height "h" of approximately one millimeter. When a vacuum is produced in the chamber 33, the washer 40 is caused to be compressed down by the face 13 of the chip 10 until the face 13 contacts the ring 41, as shown in FIG. 2*b*. The exact or particular choice of the value "h" to within one tenth of a millimeter can be determined so as to allow good sealing with the chip 10, to allow the chip 10 to bear or seat against the ring 41, and to obtain a desired bearing force due to the vacuum which is much greater than the reaction force of the washer 40 in the compressed state. In practice, by way of non-limiting example, for a chip 10 having a "granite-like" face and whose diameter is approximately forty millimeters, a silicone washer 40 can be used, whose dimensions at rest are approximately 35 mm and approximately 30 mm for the respective external and internal diameters. The washer 40 may also have a thickness "H" of approximately 4 mm with an outside excess "h" of approximately 0.7 mm and with an effective vacuum bearing area of about 10 $cm^2$.

One of the advantages afforded by the holding device 30 according to the invention is that it is able isolate the vacuum chamber 33 by closing the multiple valve 50 once the required vacuum level (for example 50%) is reached. In such an arrangement, one can disconnect the holding device 30 from the vacuum suction line 48 by simply separating the end pieces 52 and 54. By selecting a minimum internal volume of a few tens of $cm^3$ for the vacuum chamber 33, tests have shown that it is possible to preserve an operational vacuum which can maintain the chip 10 firmly on the holding device 30 for a duration of more than one hour. In practice, the height "h" is selected as the excess height which allows the longest possible time of preserving the vacuum in the chamber 33, other parameters of the system being kept the same. Depending on the desired vacuum preservation time in the pad-printing system used (a time which varies inter alia on the number of pad-printing stations, the internal volume of the vacuum chambers and the number of holding devices 30 used), it is possible to reduce to the highest accuracy the percentage of vacuum needed in the vacuum chamber(s) 33, and consequently the power required for the vacuum pump 58.

In practice, a plurality of holding devices 30 are placed on the transfer track 62 and the track is arranged to form a loop. At least one station for placing/removing chips is utilized (two stations if it is desired to turn over the chips in order to mark the other face) on the loop. The stations for which the rail 70 and the centering collar 44 of the chip 10 are in the high position (i.e., the position shown in FIG. 1) are the stations in which the chips are placed and/or removed from the holder(s) 30. The operator places the chip 10 in the opening of the collar 44 so that it is supported on the elastomer washer 40 (see also FIG. 2*a*). The chip 10 is thus centered with respect to the vertical axis ZZ' of the holding device 30. The operator then connects the two end pieces 52 and 54 in order to create a vacuum in the chamber 33. Within a few seconds, the washer 40 is caused to be compressed and the chip 10 contacts/bears firmly on the ring 41 (see FIG. 2*b*). The operator may then disconnect the two end pieces 52, 54 in order to isolate the vacuum chamber 33 (it being possible to carry out this operation either manually or in an automated manner). The holding device 30 may then be moved on the track until it reaches the first pad-printing station. At this point, the collar 44 is caused to be moved to the retracted position by the rail 70 because a portion of rail 70' in the low position (in actuality, the rail 70 controlling the collar 44 is always in the low position along the loop of the track 62 except for the locations which correspond to the placement/removal stations). When the collar 44 is in the retracted position, the face 12 of the chip 10 and the side 14 of the chip 10 are available for being marked together in the manner shown in, e.g., FIGS. 4*a* and 4*b*.

Figure 4A:
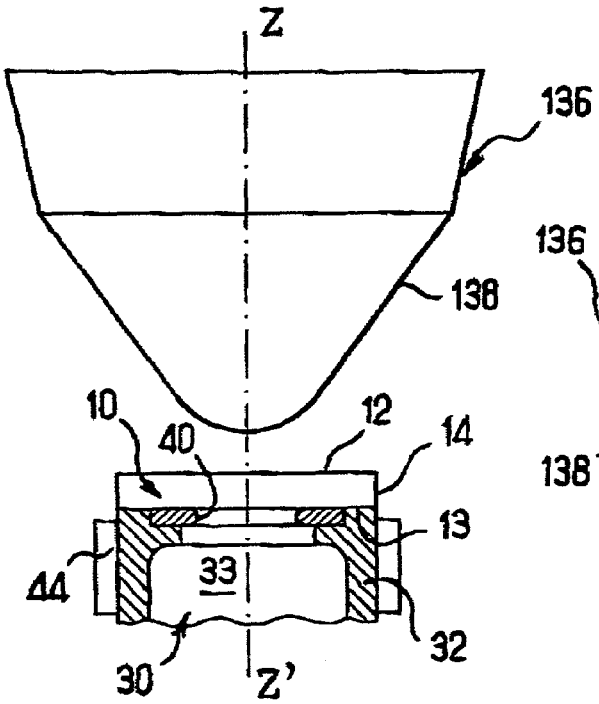
FIGS. 4*a* and 4*b* represent an operation of marking the side of a gambling chip with a perpendicular side via pad printing by way of the system illustrated in FIG. 3.
Figure 4B:
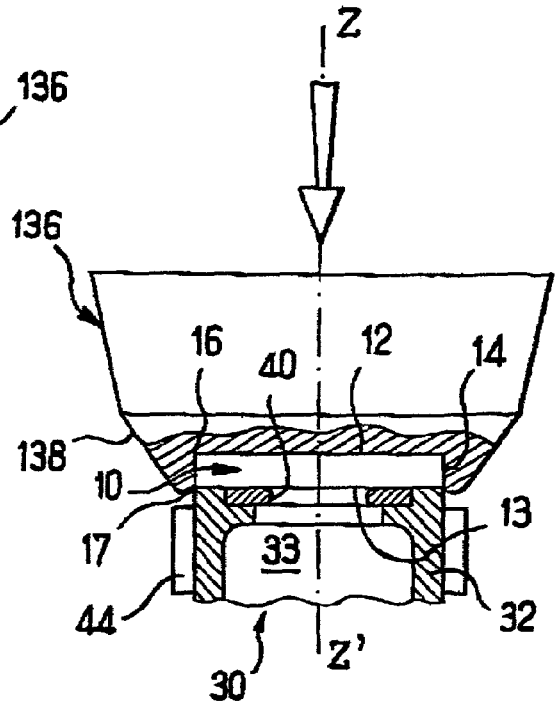

As can be seen in FIGS. 4*a* and 4*b*, the chip 10 is centered on the axis ZZ' of the pad 134 by positioning the stand 36 so as to align the axis of the pad 134 with the axis of the holding device 30. This centering operation is made prior to the actual marking (or in the initial marking phase) because it is important to position the chip 10 properly with respect to the pad 134. This is especially the case if the edge 16 is to correspond properly with its image inked on the conical end 138 of the pad 134. During the printing, after the plane of the face 12 is exceeded by the conical end 138 (the face possibly being completely marked), the head 138 of the pad 134 is deformed along the side 14 thereby bedding down onto the edge 16 (the latter being clean enough to prevent undesirable sliding from the face 12 at the edge) until the side 14 is completely inked when the end 138 (which is conical at rest) of the deformable head 136 of the pad 134 is compressed (with the rim of the head 136 going slightly beyond the plane of the edge 17 of the lower face 13 of the chip 10). The pressing force created by the vacuum on the chip 10 is large enough to prevent the chip 10 from sliding sideways during the marking and/or from lifting out of the holding device 30 while the pad 134 is retracted. The stand 36 can then be moved to the next pad-printing station until the end of marking procedure. In this way, the chip 10 may be decorated only as to a face 12, on only its side 14, or on both the face 12 and the side 14. Optionally, the chip 10 can be moved past a placement/removal station where the chip 10 is turned over after a venting of the chamber 33, i.e., the chip 10 is turned over, then the chamber 33 is evacuated, followed by isolating the chamber 33, and finally, movement of the holder 30 toward the pad-printing stations which are allocated and/or setup to print the other face 13 of the chip 10. Otherwise, the chip 10 can return back to an original placement/removal station whereupon the chamber is vented and the chip 10 is removed.

In the first embodiment of the invention described here, the holding device 30 and the associated pad-printing system or arrangement incorporates the largest number of technical features (i.e., an elastomeric washer with parallel faces, a supporting ring, and an isolation of the vacuum chamber). These are intended to comply with the most difficult conditions of use (side marking, "granite-like" faces, optimization of the vacuum resource, intermittent supply of the vacuum chamber, etc.). However, the invention also contemplates simplified versions of the holding device 30 illustrated in FIG. 1.

In one of these versions which is intended to be used under less rigorous conditions (for example for marking the faces alone), the holding device 30 remains very close to the device 30 described above, except that the supporting ring 41 is dispensed with (not required). Instead, the lower part of the elastomer washer 40 is placed in a groove made in the widened portion 38 (instead of the shoulder 39) and the face 12 of the chip 10 is axially positioned during pad printing by crushing the elastomer washer 40.

In yet another version of the invention, the holding device 30 conforms to the device shown in FIG. 1 except for the multiple valve system being replaced by a fixed and permanent connection between the vacuum chamber 30 and the vacuum suction source 58. One way to accomplish this is to attach the vacuum source to the movable holder 30 (i.e., the holder 30 and vacuum source 58 move as a unit). Another way is configure the vacuum source 58 so that it need not be disconnected from the holders 30 when the holders 30 move on the track 62. In these ways, the quality of the sealing at the chip 10 allows the pad-printing operation to be carried out correctly but with a slightly more expensive system.

It is noted that the foregoing examples have been provided merely for the purpose of explanation and are in no way to be construed as limiting of the present invention. While the present invention has been described with reference to an exemplary embodiment, it is understood that the words that have been used are words of description and illustration, rather than words of limitation. Changes may be made, within the purview of the appended claims, as presently stated and as amended, without departing from the scope and spirit of the present invention in its aspects. Although the invention has been described herein with reference to particular means, materials and embodiments, the invention is not intended to be limited to the particulars disclosed herein. Instead, the invention extends to all functionally equivalent structures, methods and uses, such as are within the scope of the appended claims.

What is claimed:

1. A holding arrangement for a chip comprising:

a support having a first end for supporting the chip;

a vacuum chamber arranged in the support;

the first end comprising an opening that communicates with the vacuum chamber;

an annular seal arranged around the opening at the first end;

a vacuum source which evacuates the vacuum chamber;

a multiple valve assembly coupled to the vacuum chamber, wherein the multiple valve assembly allows a user to control the pressure inside the vacuum chamber and wherein the multiple valve assembly is capable of isolating the vacuum chamber and of connecting the vacuum chamber either to the vacuum source or to an ambient source of air, and the support being mounted to a stand that is movably guided at least between a position wherein the vacuum chamber is connected to the vacuum source and a position wherein the vacuum chamber is isolated.

2. The holding arrangement of claim 1, wherein the first end comprises an upper surface and the annular seal extends above the upper surface, and wherein the annular seal is compressed when the chip is installed on the first end, when the vacuum chamber is evacuated, and when the chip abuts the upper surface.

3. The holding arrangement of claim 1, wherein the support comprises a cylindrically shaped support, the opening comprises a central opening, and the annular seal is arranged concentrically with the central opening.

4. The holding arrangement of claim 1, wherein the chip comprises one of a gambling chip, a token and a tile.

5. The holding arrangement of claim 1, wherein the holding arrangement is adapted to be used in a pad printing system.

6. The holding arrangement of claim 1, wherein the annular seal comprises an elastomeric material.

7. The holding arrangement of claim 6, wherein the annular seal comprises at least one of a synthetic rubber, a natural rubber, a polyurethane, and a silicone.

8. The holding arrangement of claim 1, wherein the annular seal is a washer having flat faces.

9. The holding arrangement of claim 1, wherein the annular seal is arranged concentrically to an axis running through the support.

10. The holding arrangement of claim 1, wherein the first end of the support comprises a ring-shaped support portion.

11. The holding arrangement of claim 10, wherein the ring-shaped support portion is sized to receive the annular seal.

12. The holding arrangement of claim 11, wherein the annular seal projects above an upper surface of the ring-shaped support portion.

13. The holding arrangement of claim 12, wherein, when the chip is installed on the first end and the vacuum chamber is evacuated, the annular seal is compressed by an amount equal to the amount that the annular seal projects above the upper surface of the ring-shaped support portion.

14. The holding arrangement of claim 13, wherein the annular seal ensures a vacuum-tight sealing between a face of the chip and the annular seal.

15. The holding arrangement of claim 1, further comprising a centering device for centering the chip on the support.

16. The holding arrangement of claim 15, wherein the centering device is axially movably mounted to the support.

17. The holding arrangement of claim 16, wherein the first end of the support comprises a ring-shaped support portion.

18. The holding arrangement of claim 17, wherein the centering device is movable from an extended position above the ring-shaped support portion to a retracted position below the ring-shaped support portion.

19. The holding arrangement of claim 15, wherein the centering device includes a centering collar secured to a sleeve which is slidable with respect to the support.

20. The holding arrangement of claim 19, further comprising at least one mechanism for biasing the centering device towards an extended position.

21. The holding arrangement of claim 19, further comprising at least one mechanism for biasing at least one of the centering collar and the sleeve towards an extended position.

22. The holding arrangement of claim 1, wherein the multiple valve assembly comprises a three-way valve.

23. The holding arrangement of claim 22, wherein the multiple valve system includes a connection system.

24. The holding arrangement of claim 23, wherein the connection system comprises two non-return valves having two disconnectable end pieces.

25. The holding arrangement of claim 24, wherein one of the two disconnectable end pieces is a connection and isolation end piece having a non-return valve and being configured to be connected to the vacuum chamber.

26. The holding arrangement of claim 24, wherein one of the two disconnectable end pieces is a suction end piece having a non-return valve.

27. The holding arrangement of claim 1, further comprising a frame wherein the stand is movable with respect to the frame.

28. The holding arrangement of claim 1, further comprising at least one pad-printing station comprising an ink pad which is movable coaxially and a flat inking plate, wherein the support is movable from a position outside the pad printing station to a position within the pad printing station.

29. A holding arrangement for a chip comprising:

a support having a first end for supporting the chip;

a vacuum chamber arranged in the support;

the first end comprising an opening that communicates with the vacuum chamber;

an annular seal arranged around the opening at the first end;

a vacuum source which evacuates the vacuum chamber; and a multiple valve assembly coupled to the vacuum chamber, wherein the multiple valve assembly allows a user to control the pressure inside the vacuum chamber and wherein the multiple valve assembly comprises a three-way valve which is capable of isolating the vacuum chamber and of connecting the vacuum chamber either to the vacuum source or to an ambient source of air, wherein the multiple valve system includes a connection system, wherein the connection system comprises two non-return valves having two disconnectable end pieces, and wherein one of the two disconnectable end pieces is a connection and isolation end piece having a non-return valve and being configured to be connected to the vacuum chamber and wherein another of the two disconnectable end pieces is a suction end piece having a non-return valve and being configured to be connected to the vacuum source, and wherein the two non-return valves are mounted face to face in order to butt against each other in a double opening position when the two end pieces are connected.

30. A pad-printing arrangement for printing a chip comprising:

at least one pad-printing station which includes an ink pad that is movable towards and away from the chip and a flat ink plate;

at least one holding device including a support having a first end for supporting the chip, a vacuum chamber arranged in the support, the first end comprising an opening that communicates with the vacuum chamber, an annular seal arranged around the opening at the first end, and a vacuum source which evacuates the vacuum chamber, the support being mounted on a movable stand;

a frame having a track mounted thereto;

at least one chip placement/removal station arranged adjacent the frame; and a multiple valve assembly coupled to the vacuum chamber, wherein the multiple valve assembly allows a user to control the pressure inside the vacuum chamber and wherein the multiple valve assembly is capable of isolating the vacuum chamber and of connecting the vacuum chamber either to the vacuum source or to an ambient source of air, wherein the stand is movable on the track, and wherein the support is movable from a position outside the pad printing station to a position within the pad printing station and wherein the vacuum chamber is capable of being isolated prior to the support being positioned within the pad printing station.

31. A holding arrangement for a chip comprising:

a support having a first end for supporting the chip;

the support being mounted to a stand that is movably guided;

a space arranged in the support;

a seal having a through opening arranged at the first end;

a collar movably mounted to the first end of the support and being arranged to surround the seal;

a vacuum source which evacuates the space; and an opening arranged between the space and the through opening of the seal, wherein the seal is compressed when the chip is installed on the first end and when the space is evacuated, and wherein the collar is a centering collar secured to a sleeve which is slidable with respect to the support.

32. The holding arrangement of claim 31, further comprising at least one mechanism for biasing at least one of the centering collar and the sleeve towards an extended position.

33. A holding arrangement for a chip comprising:

a support having a first end for supporting the chip;

the support being mounted to a stand that is movably guided;

a space arranged in the support;

a seal having a through opening arranged at the first end;

a collar movably mounted to the first end of the support and being arranged to surround the seal;

a vacuum source which evacuates the space;

an opening arranged between the space and the through opening of the seal;

a frame;

the stand is movable with respect to the frame; and at least one pad-printing station comprising an ink pad which is movable and a flat inking plate, wherein the support is movable from a position outside the pad printing station to a position within the pad printing station, wherein the seal is compressed when the chip is installed on the first end and when the space is evacuated.

34. A holding arrangement for a chip comprising:

a support having a first end for supporting the chip;

the support being mounted to a stand that is movably guided on a track;

a vacuum chamber arranged in the support;

an annular seal arranged at the first end;

a collar movably mounted to the first end;

a vacuum source which evacuates the vacuum chamber; and a multiple valve assembly coupled to the vacuum chamber, wherein the multiple valve assembly allows a user to control the pressure inside the vacuum chamber and wherein the multiple valve assembly comprises a three-way valve which is capable of isolating the vacuum chamber and of connecting the vacuum chamber either to the vacuum source or to an ambient source of air.

35. A holding arrangement for a chip comprising:

a support having a first end for supporting the chip;

the first end comprising a peripheral projecting wall having an upper surface and a shoulder;

a collar movably mounted to the first end;

a vacuum chamber arranged in the support;

an opening communicating with the vacuum chamber and extending to the shoulder;

a compressible annular seal supported on the shoulder and arranged within the peripheral projecting wall;

a vacuum source which evacuates the vacuum chamber; and a multiple valve assembly coupled to the vacuum chamber, wherein the multiple valve assembly allows a user to control the pressure inside the vacuum chamber and wherein the multiple valve assembly is capable of isolating the vacuum chamber and of connecting the vacuum chamber either to the vacuum source or to an ambient source of air, wherein, when the annular seal is not compressed, a portion of the annular seal extends above the upper surface of the peripheral projecting wall.

36. The holding arrangement of claim 35, wherein the annular seal comprises a rectangular cross-section.

37. The holding arrangement of claim 35, wherein the annular seal comprises an O-ring.

38. The holding arrangement of claim 35, wherein the multiple valve assembly comprises a three-way valve.

39. A holding arrangement for a chip comprising:

a support having a first end for supporting the chip;

a space arranged in the support;

a seal arranged at the first end;

a vacuum source which evacuates the space;

a collar movably mounted to the first end; and a multiple valve assembly coupled to the space, wherein the multiple valve assembly allows a user to control the pressure inside the space and wherein the multiple valve assembly comprises a three-way valve which is capable of isolating the space and of connecting the space either to the vacuum source or to an ambient source of air, wherein the seal is compressed when the chip is installed on the first end and when the space is evacuated, and wherein the first end comprises an upper surface and the seal extends above the upper surface, and wherein the seal is compressed when the chip is installed on the first end, when the chip abuts the upper surface, and when the space is evacuated.

40. A holding arrangement for a chip comprising:

a support having a first end for supporting the chip;

the first end comprising an annular peripheral projecting wall having an upper surface;

a collar movably mounted to the first end;

a space arranged in the support;

an opening communicating with the space;

an annular compressible seal supported on the first end;

a vacuum source which evacuates the space; and a multiple valve assembly coupled to the space, wherein the multiple valve assembly allows a user to control the pressure inside the space and wherein the multiple valve assembly comprises a three-way valve which is capable of isolating the space and of connecting the space either to the vacuum source or to an ambient source of air, wherein, when the annular compressible seal is not compressed, a portion of the annular compressible seal extends above the upper surface of the annular peripheral projecting wall, and wherein the annular compressible seal is compressed when the chip abuts the upper surface and when the space is evacuated.

41. A holding arrangement for a chip comprising:

a support having a first end for supporting the chip;

a vacuum chamber arranged in the support;

an annular seal arranged at the first end;

a vacuum source which evacuates the vacuum chamber; and a multiple valve assembly coupled to the vacuum chamber, wherein the multiple valve assembly allows a user to control the pressure inside the vacuum chamber and wherein the multiple valve assembly comprises a three-way valve which is capable of isolating the vacuum chamber and of connecting the vacuum chamber either to the vacuum source or to an ambient source of air.

* * * * *